US008667744B2

(12) United States Patent
Shaw

(10) Patent No.: US 8,667,744 B2
(45) Date of Patent: Mar. 11, 2014

(54) SHIELDING DEVICE AND ASSOCIATED METHODS

(76) Inventor: Michael L. Shaw, Windsor (CA)

( * ) Notice: Subject to any disclaimer, the term of this patent is extended or adjusted under 35 U.S.C. 154(b) by 204 days.

(21) Appl. No.: 13/204,304

(22) Filed: Aug. 5, 2011

(65) Prior Publication Data

US 2013/0031846 A1 Feb. 7, 2013

(51) Int. Cl.
*E04D 15/00* (2006.01)
*E04C 2/38* (2006.01)

(52) U.S. Cl.
USPC ..... 52/97; 52/483.1; 52/716.2

(58) Field of Classification Search
USPC ..... 52/97, 483.1, 716.2, 300, 489.1, 489.2, 52/702, 715
See application file for complete search history.

(56) References Cited

U.S. PATENT DOCUMENTS

| | | | | |
|---|---|---|---|---|
| 876,399 | A * | 1/1908 | Robinson | 52/714 |
| 1,888,611 | A * | 11/1932 | Wolfson | 52/512 |
| 1,889,138 | A * | 11/1932 | Wolfson | 52/512 |
| 3,512,325 | A * | 5/1970 | Nichols | 52/483.1 |
| 5,280,692 | A * | 1/1994 | Patey | 52/716.2 |
| 5,410,854 | A * | 5/1995 | Kimmell et al. | 52/712 |
| 5,479,750 | A * | 1/1996 | Carlberg | 52/300 |
| 5,772,185 | A * | 6/1998 | Pulsipher | 256/59 |
| 6,108,922 | A | 8/2000 | Lee | |
| D447,575 | S | 9/2001 | Shaw | |
| 6,449,911 | B1 * | 9/2002 | Hudson | 52/58 |
| D489,316 | S * | 5/2004 | Almhill | D12/412 |
| 7,566,035 | B2 * | 7/2009 | Bonshor | 248/205.1 |
| 7,681,362 | B1 * | 3/2010 | Averitt | 52/169.12 |
| 8,001,739 | B1 * | 8/2011 | Inzeo et al. | 52/300 |
| 8,146,303 | B2 * | 4/2012 | Gibson et al. | 52/177 |
| 2004/0079039 | A1 * | 4/2004 | Shaw | 52/300 |
| 2008/0196321 | A1 | 8/2008 | Kronemeyer | |

FOREIGN PATENT DOCUMENTS

| | | |
|---|---|---|
| CA | 2286412 | 12/2004 |

* cited by examiner

*Primary Examiner* — Brian Glesssner
*Assistant Examiner* — Joseph J Sadlon
(74) *Attorney, Agent, or Firm* — Mark R. Malek; Zies Widerman & Malek

(57) ABSTRACT

A shielding device for protecting decks from rotting includes an upper member, a pair of opposing main body sidewalls, an upper grip, and a side tab. The main body sidewalls may include a first portion and a second portion terminating with a drip edge. The upper grip may protrude from the bottom of the upper member, and the side tab may protrude from the inner portion of at least one of the main body sidewalls.

15 Claims, 5 Drawing Sheets

SHIELDING DEVICE AND ASSOCIATED METHODS

FIELD OF THE INVENTION

The present invention relates to the field of construction and, more specifically, to shielding devices to be used with decks, and associated methods.

BACKGROUND OF THE INVENTION

Shielding devices have been used to protect constructed decks from water damage. The intersection of joists and upper deck boards may be prone to collection of excess moisture, which may cause premature rotting. Because many decks are constructed of wood, this may be a serious and common problem.

Many attempted solutions to this problem only provide protection for a lowermost piece of lumber, i.e., the joist. However, without protecting both upper and lower pieces of lumber, the previously attempted solutions of the prior art are insufficient. If only the bottom piece of lumber is protected, the water may pool at the joint between the device and the upper board, which may, in turn, cause water to wick up through the upper board via capillary action. Accordingly, this may cause upper deck boards to rot.

U.S. Pat. No. 6,108,992 to John Shaw discloses a shielding device for preventing wood rot. More specifically, the '992 Shaw patent discloses a wood rot protector that includes a plurality of grooves formed through an underside. This structure reduces contact between the upper board and the shield. However, the device fails to truly minimize contact to prevent water wicking.

There exists a need for a shielding device that prevents, or substantially minimizes, rotting of the upper boards. There further exists a need for a shielding device that allows for air circulation, and that can be installed in a manner to prevent excess movement.

SUMMARY OF THE INVENTION

With the foregoing in mind, the present invention is related to a shielding device that advantageously minimizes or prevents liquid damage to a board, or joist, of a constructed deck. The invention may also advantageously allow for air circulation between the board, or joist, and the shielding device, which may further prevent damage of a constructed deck. The present invention may further advantageously prevent excess movement during construction, which may allow for greater ease of use. The shielding device of the present invention is still further advantageously simple to install, thereby reducing man-hours required for construction.

These and other objects, features, and advantages according to the present invention are provided by a shielding device that may include an upper member, a pair of opposing main body sidewalls, an upper grip and a side tab. The upper member may be defined by a top, upper member sidewalls which may extend downwardly from the top, and a bottom opposite the top and connected to the upper member sidewalls. The upper member sidewalls may extend substantially orthogonal between the top and the bottom.

The pair of opposing main body sidewalls may extend downwardly from the upper member, and may each have a first portion and a second portion. The first portion may be connected to the upper member and extend downwardly and inwardly, while the second portion may extend downwardly and outwardly from an end of the first portion to define each of the pair of main body sidewalls as terminating with a drip edge. The first portion may extend inwardly so that a width between the pair of main body sidewalls adjacent the upper member is greater than a width between the pair of main body sidewalls adjacent the end of the first portion. The top of the upper member may be rounded, and the bottom of the upper member may be flat.

The upper grip may longitudinally protrude along at least a part of the length of the bottom of the upper member. The upper grip may be pointed. Additionally, the upper grip may comprise a plurality of upper grips that may be oriented substantially parallel to one another.

A side tab may be included on the inner portion of at least one of the main body sidewalls and may longitudinally protrude along at least a part of its length. The side tab may further be pointed. The side tab may also be hook-shaped. In some embodiments of the present invention, the side tab may include a pair of opposing side tabs that extend substantially parallel to one another. The upper member, pair of opposing main body sidewalls, upper grip, and side tab may be formed as a monolithic unit. The shielding device may be made of a plastic material.

A method aspect of the present invention for using the shielding device may include operatively positioning the device to overlie an upper side of a joist. The method may also include applying force to the upper member of the shielding device such that the upper grip may abut the joist. The method may further include applying force to at least one of the pair of opposing main body sidewalls such that the side tab may engage at least a portion of the joist.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Referring now to FIGS. 1-5, a shielding device 10 according to an embodiment of the present invention is now described in greater detail. Throughout this disclosure, the shielding device 10 may also be referred to as the device or the invention. Alternate references of the shielding device 10 in this disclosure are not meant to be limiting in any way.

Figure 1:
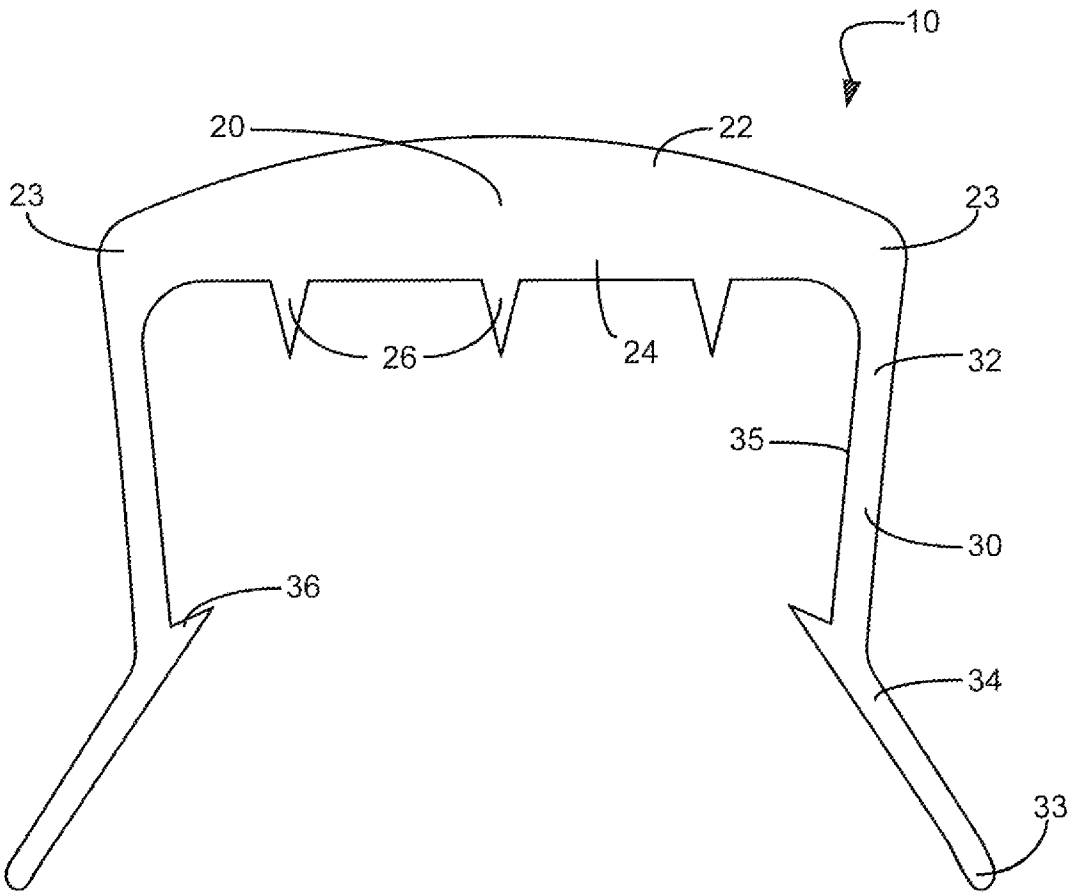
FIG. 1 is a side elevation view of the shielding device according to an embodiment of the present invention.

As perhaps best illustrated in FIG. 1, the shielding device 10, according to an embodiment of the present invention, may include an upper member 20 having a top 22, a bottom 24, and a pair of upper member sidewalls 23 connected to the top 22 and the bottom 24, and extending substantially orthogonal between them. A pair of opposing main body sidewalls 30 may extend substantially downwardly from the upper member 20 and, more specifically, may extend downwardly from a lower portion of each of the upper member sidewalls 23.

Each of the main body sidewalls 30 may have a first portion 32 and a second portion 34. The first portion 32 of each of the main body sidewalls 30 may extend downwardly and inwardly from the upper member 20. The second portion 34 of each of the main body sidewalls 30 may be connected to the first portion 32 and extend downwardly and outwardly therefrom, terminating at a drip edge 33, which will later be discussed in greater detail. Accordingly, and when viewing the shielding device 10 from the side, as illustrated, for example, in FIG. 1, the main body sidewalls 30 may appear to have an hourglass shape. Those skilled in the art will appreciate that describing the main body sidewalls 30 as having an hourglass shape is intended for illustrative purposes only, and not meant to be limiting in any way. The upper member sidewalls 23 and the main body sidewalls 30 are illustrated, for example, in FIG. 1 as being a single unit. Accordingly, the shielding device 10 according to an embodiment of the present invention may be described as having sidewalls, which include both the upper member sidewalls 23 and the main body sidewalls 30 that extend downwardly from the upper member 20. As perhaps best illustrated in FIG. 2, the upper member sidewalls 23 may be distinct from the main body sidewalls 30 and, as will be discussed in greater detail below, may still be extruded as an integrally formed monolithic unit.

The upper member 20 may have an arcuate top 22 and a flat bottom 24. A skilled artisan will appreciate that the upper member 20 need not necessarily be formed with an arcuate top 22 and a flat bottom 24 and, in fact, the shielding device 10 according to the present invention allows for a variety of shapes for the top 22 and bottom 24 of the upper member 20 while still accomplishing the goals, features, and objectives according to the present invention. For example, the top 22 of the upper member 20 may have a substantially flat shape. The skilled artisan will appreciate, however, that it is preferable for the top 22 to have an arcuate shape that advantageously allows for water runoff. This can also be accomplished with any other shape that provides for a slope for water to runoff such as, for example, a triangle, or any radius of curve. Allowing for water runoff advantageously prevents or substantially reduces the wicking of water into a layer of building material on top of the shielding device 10 of the present invention, such as an upper board 42 in FIG. 3.

The shielding device 10 according to an embodiment of the present invention may also include an upper grip 26 that protrudes downwardly from the bottom 24 of the upper member 20. The embodiment of the shielding device 10 illustrated in FIG. 1 shows a plurality of upper grips 26 that have a pointed shape and that extend substantially parallel to one another. Those skilled in the art will appreciate that the shielding device 10 according to the present invention contemplates any number of upper grips 26 extending downwardly from the upper member 20 while still accomplishing the goals, features, and objectives according to the present invention. The upper grips 26 illustrated in FIG. 1 are illustrated as being triangular and extending downwardly from the bottom 24 of the upper member 20 so that each of the upper grips 26 terminate in a pointed end. It is contemplated that the pointed configuration of the upper grips 26 may bite into a joist 40 (FIG. 3), or other decking structure, that the shielding device 10 is connected to. A skilled artisan will appreciate, however, that the upper grips 26 may terminate an end that is not pointed, which may still allow the upper grips 26 to partially bite into the joist 40, to be included within the scope and spirit of the present invention.

The shielding device 10 according to the present invention may also include a side tab 36 longitudinally protruding from an inner surface 35 along all or part of each of the pair of main body sidewalls 30. The side tabs 36 may be described as being an extension of the second portion 34 of each of the main body sidewalls 30, i.e., if the second portion 34 of each of the main body sidewalls 30 are defined as having an upper portion and a lower portion, then the side tabs 36 may be considered to be an extension of the upper portion. The side tabs 36 may also be pointed and/or hook-shaped, and may extend substantially parallel to each other. FIG. 1 illustrates the use of substantially parallel side tabs 36 having a pointed shape. Those skilled in the art will appreciate that the shielding device 10 according to the present invention may have side tabs 36 of any number of shapes while still accomplishing the goals, features, and objectives according to the present invention.

The side tabs 36 advantageously allow for the shielding device 10 according to the present invention to be positioned over an end of a joist 40, or other decking structure, and secured in place. Accordingly, the side tabs 36 may bite into a portion of the joist 40 to secure the shielding device 10 in place and prevent movement thereof. This advantageously minimizes or prevents movement of the shielding device 10 after it has been installed to overlie a portion of the joist 40, while simultaneously allowing air to flow between the joist 40 and the shielding device 10.

Figure 2:
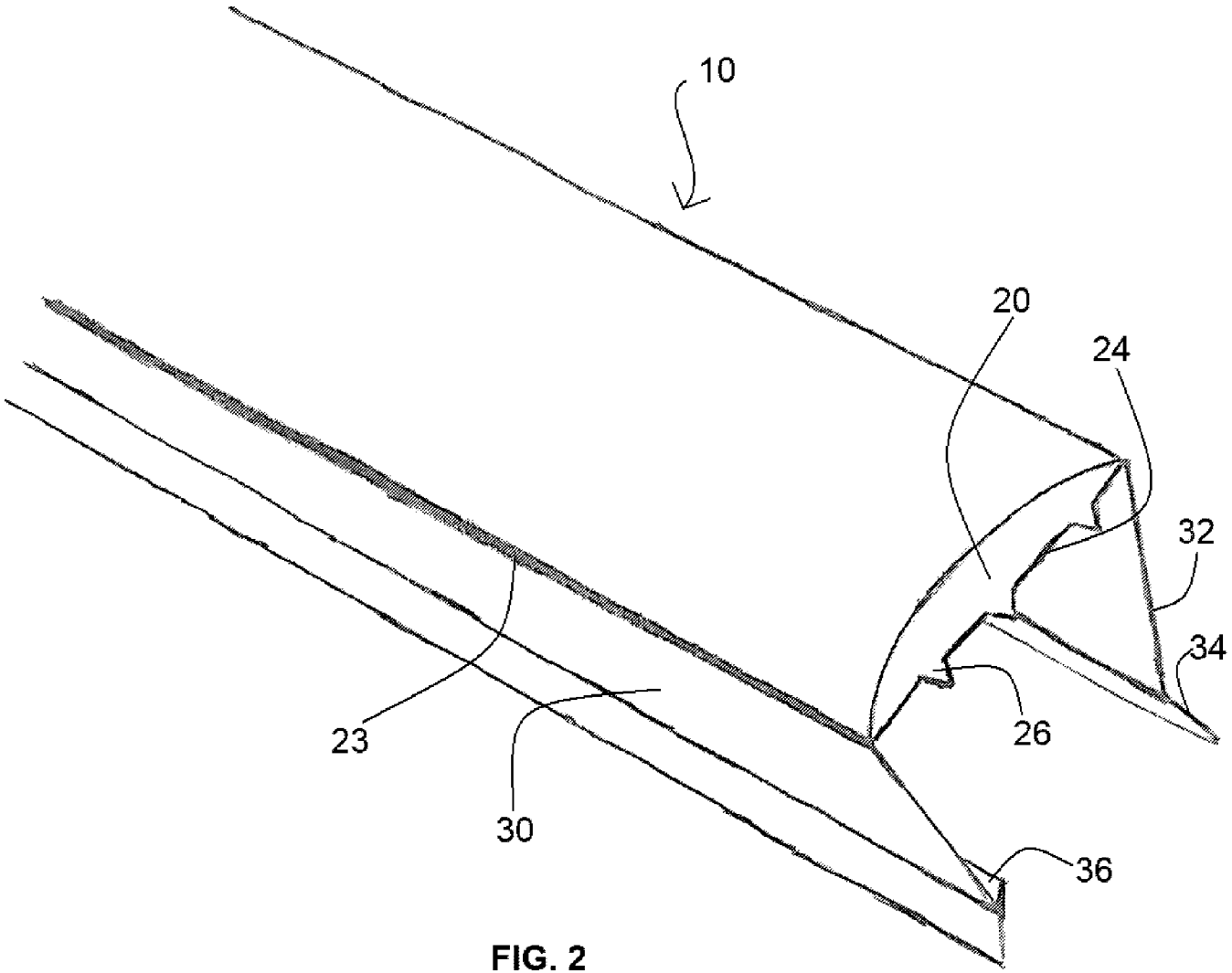
FIG. 2 is a partial perspective view of the shielding device illustrated in FIG. 1.

As perhaps best illustrated additionally in FIG. 2, the shielding device 10 of an embodiment of the present invention, and, more specifically, the upper member 20, main body sidewalls 30, upper grips 26, and side tabs 36, of the shielding device may be integrally formed as a monolithic unit. The device 10 may also be made of a plastic material. A person skilled in the art will appreciate the cost-effectiveness of manufacturing a shielding device 10 of the present invention from a plastic material as an integrally formed monolithic unit through extrusion. The skilled artisan will further appreciate, however, that other materials may also be used, and the suggestion of a plastic material is not intended to be limiting in any way. Further, those skilled in the art will appreciate that the shielding device 10 according to an embodiment of the present invention may be manufactured any number of ways while still accomplishing the goals, features, and objectives according to the present invention.

Figure 3:
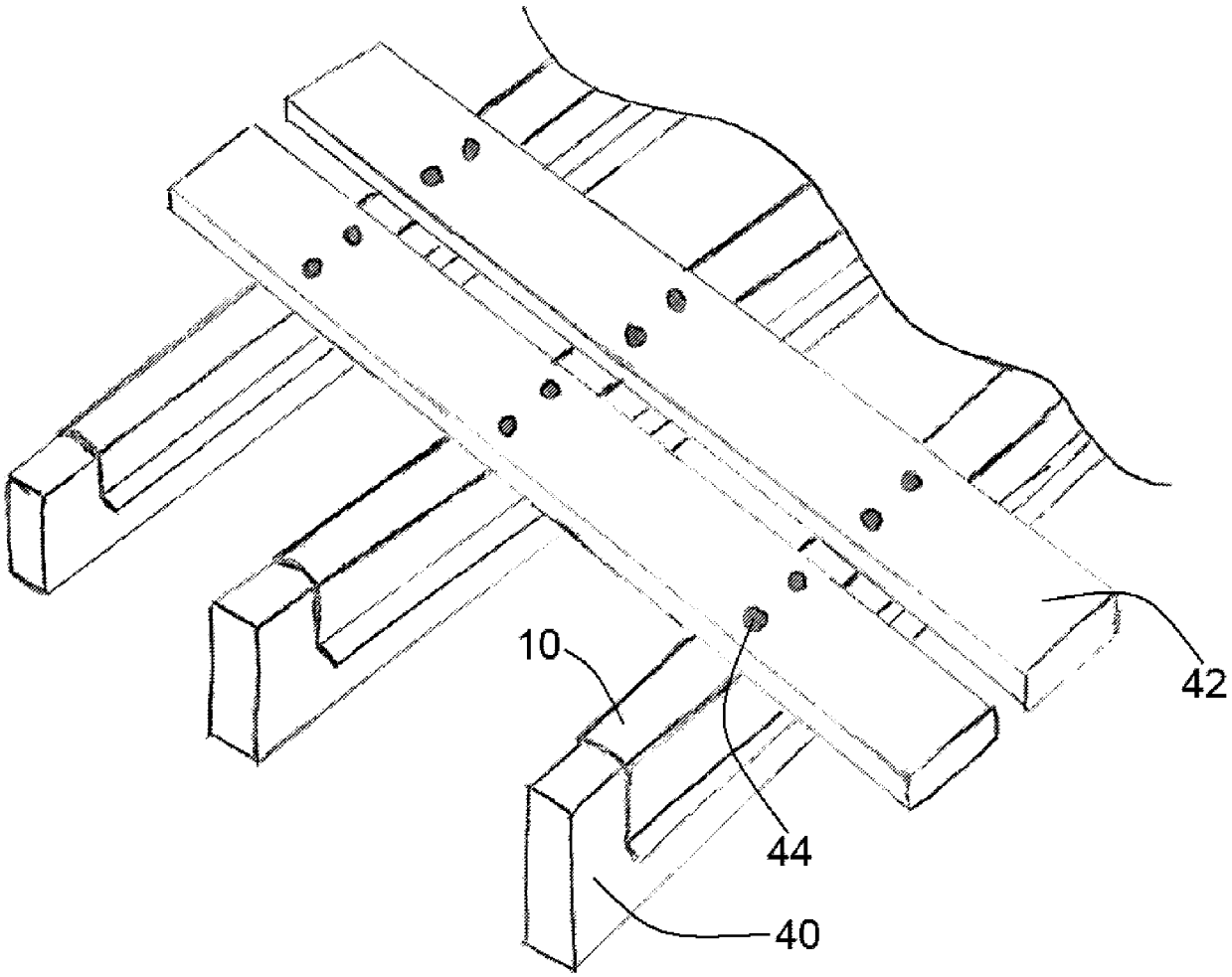
FIG. 3 is a partial environmental view of the shielding device illustrated in FIG. 1 being applied to a portion of a joist.
Figure 4:
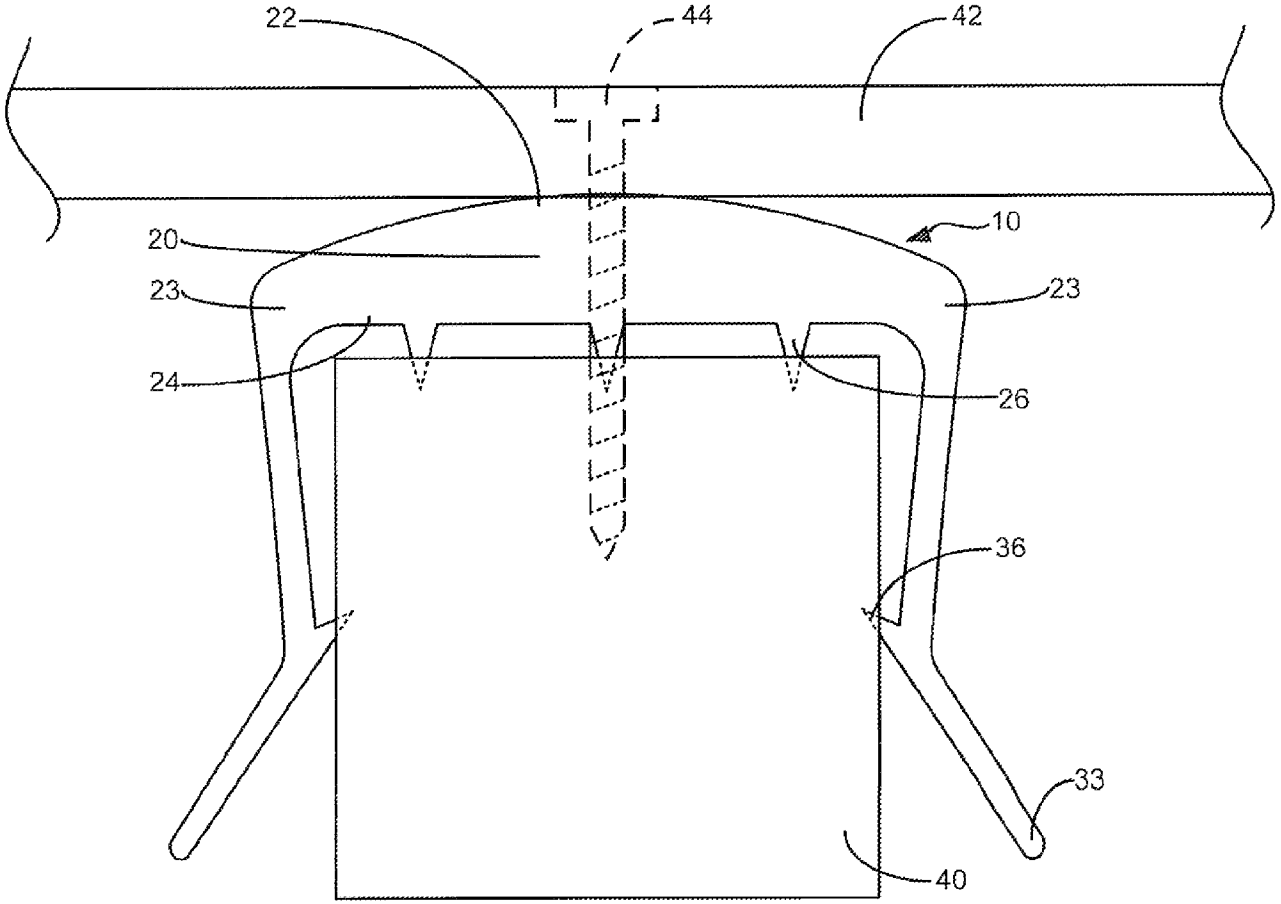
FIG. 4 is a cross-sectional side elevation view of the shielding device illustrated in FIG. 1 being connected to a portion of a joist with a medially positioned fastener.
Figure 5:
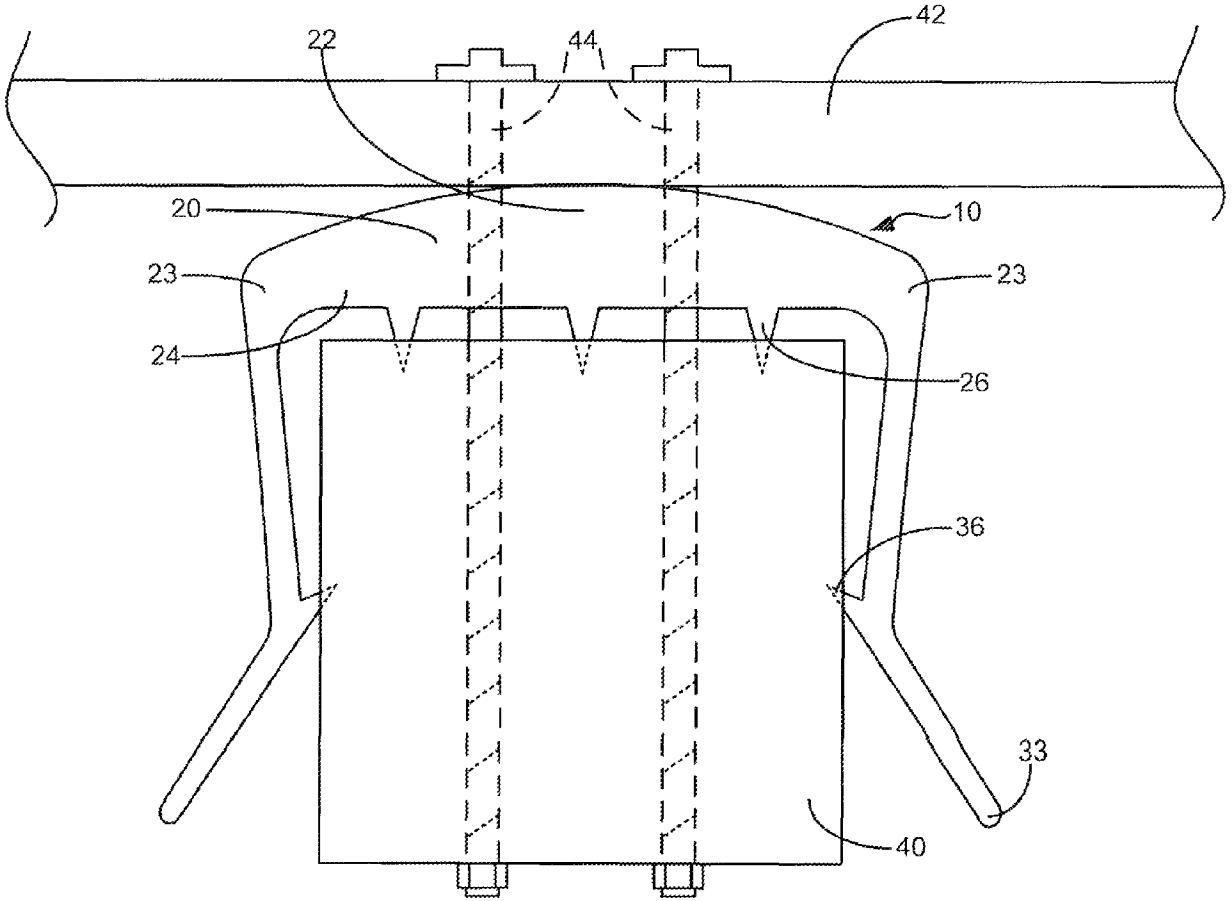
FIG. 5 is a cross-sectional side elevation view of the shielding device illustrated in FIG. 1 being connected to a portion of a joist with a plurality of fasteners.

The shielding device 10 of the present invention may be used in the construction of decks, for example, as shown in FIGS. 3-5. As earlier discussed, the shielding device 10 is described as having an upper member 20 which includes a top 22, a bottom 24, an upper grip 26, and a pair of upper member sidewalls 23 that extend between the top 22 and the bottom 24. More specifically, the upper member sidewalls 23 preferably extend substantially orthogonal between the top 22 and the bottom 24 of the upper member 20. Although the upper member sidewalls 23 are illustrated as extending orthogonally between the top 22 and the bottom 24 of the upper member 20, those skilled in the art will appreciate that the upper member sidewalls 23 may also extend at an angle between the top and the bottom of the upper member while still accomplishing the goals, features, and advantages according to the present invention.

Additionally, the top 22 of the upper member 20 may be arcuate while the bottom 24 of the upper member 20 may be flat. A rounded top 22 of the upper member 20 may advantageously provide a slope for water runoff. The inclusion of a slope or rounding at the top 22 of the upper member 20 may substantially reduce, or altogether prevent, wicking of water via capillary action into an upper board 42, substantially reducing the occurrence of rot in the upper board 42.

The pair of opposing main body sidewalls 30 illustratively extend downwardly from the upper member 20. Each of the opposing main body sidewalls 30 may preferably include a side tab 36, as well as a first portion 32 and a second portion 34. As perhaps best illustrated in FIGS. 4 and 5, when viewing the shielding device 10 in a cross sectional view, the main body sidewalls 30 may have an hourglass shape.

As discussed above, each of the opposing main body sidewalls 30 extend downwardly from the upper member 20 and have a first portion 32 and a second portion 34. The first portion 32 is connected to the upper member 20 and extends downwardly therefrom. More specifically, the first portion 32 is connected to an end of the upper member sidewalls 23 adjacent the bottom 24 of the upper member 20 and extends downwardly therefrom. The second portion 34 of the main body sidewalls 30 extends downwardly from an end of the first portion 32 of the main body sidewalls.

The first portion 32 of the main body sidewalls 30 preferably extends downwardly and inwardly from the bottom 24 of the upper member 20, while the second portion 34 of the main body sidewalls 30 preferably extends downwardly and outwardly from an end of the first portion 32 to define each of the pair of main body sidewalls 30 as terminating with a drip edge 33. The drip edge 33 advantageously allows for water that runs off the upper member 20 of the shielding device 10 to be directed away from the joist 40. More specifically, the drip edge 33 termination of the main body sidewalls 30 of shielding device 10 advantageously slows or altogether prevents wicking of water, or other fluid, to thereby decrease or eliminate water intrusion into a joist 40 which may, in turn, cause the joist 40 to rot. A person of skill in the art will understand wicking to be defined as the upward movement of water via capillary action. Examples of water moving upward due to capillary action may include, but should not be limited to, the movement of water up a fibrous material such as wooden joist 40, a porous material such as concrete, or between the inner surface of a main body sidewall 30 and an adjacently located joist 40.

As indicated above, the first portion 32 of the main body sidewalls 30 may extend inwardly. More specifically, the width between the pair of main body sidewalls 30 adjacent the upper member 20 is preferably greater than the width between the pair of main body sidewalls 30 adjacent the end of the first portion 32. The inward extension of the first portion 32 of the main body sidewalls 30 advantageously enhances a grip between the shielding device 10 and the joist 40 by squeezing the joist 40 when the shielding device 10 is positioned to overlie the joist 40. This inward extension, together with the upper grips 26 and the side tabs 36 advantageously enhance a connection between the shielding device 10 and the joist 40.

A method aspect of the present invention is for using the above described shielding device 10. The method may include operatively positioning the shielding device 10 to overlie a joist 40. The method may also include applying a force to the upper member 20 of the shielding device 10 such that the upper grip 26 abuts the joist 40. Force may further be applied to at least one of the pair of opposing main body sidewalls 30 such that the side tab 36 may engage at least a portion of the joist 40, as illustrated, for example, in FIGS. 4 and 5. The side tab 36 may also partially bite into the joist 40, as also shown in FIGS. 4 and 5. A person of skill in the art will appreciate the advantages that having the side tab 36 bite into the joist 40 provides, such as limiting lateral movement of the shielding device 10 during installation. The skilled artisan will also readily recognize that the side tab 36 need not necessarily bite into the joist 40 to accomplish the goals, features, and objectives of the present invention.

More particularly, after the shielding device 10 is positioned to overlie the joist 40, the force that may be applied to the upper member 20 is preferably sufficient to drive at least a portion of the upper grips 26 into a portion of the joist 40. Accordingly, the engagement of the upper grips 26 with joist 40 such that the upper grips 26 partially bite into the joist 40 advantageously prevents, or substantially decreases, lateral movement of the shielding device 10 when connected to the joist 40. As will be discussed in greater detail below, the shielding device 10 may also be connected to and secured to the joist 40 using a fastener 44.

At least a portion of the side tabs 36 may advantageously be driven into a surface of the joists 40 (preferably the side surface) when the force is applied to the shielding device 10. The engagement between the side tabs 36 of the shielding device 10 and the joist 40 advantageously prevents, or substantially decreases movement between the shielding device 10 and the joist 40 after the shielding device 10 has been secured thereto.

Referring back to FIG. 3, the shielding device 10, according to an embodiment of the present invention, will now be discussed in use on a partially constructed deck. The use of the shielding device 10 as shown in FIG. 3 is provided for purposes of demonstration, and is not intended to be limiting in any way. Other uses may readily come to mind of one skilled in the art having the benefit of this disclosure, and are intended to be included within the scope and spirit of the present invention. The shielding device 10 may overlie the joist 40. A force may be applied to the joist 40 so that it may be sheathed by the shielding device 10. An additional layer of building material, such as an upper board 42, may overlie the shielding device 10. The shielding device 10 may be secured using a fastener 44, such as a nail, a screw, a bolt, an adhesive, or any combination thereof. A skilled artisan will appreciate that the shielding device 10 may be secured to the joist 40 using any number and any combination of fasteners, and a plethora of additional types of fasteners that may be readily appreciated after having the benefit of this disclosure.

As discussed above, when the shielding device 10 is positioned to abut the joist 40, the upper grip 26 may bite partially into the joist 40, as shown in FIGS. 4 and 5. Force may be applied to at least one of the main body sidewalls 30 such that the side tabs 36 may partially bite into the joist 40 as well. FIGS. 4 and 5 also show a few examples of fasteners 44 that may be used through the upper board 42, the shielding device 10, and the joist 40. FIG. 4 illustrates the use of a screw as a fastener 44, which may be driven through the upper board 42, shielding device 10, and/or joist 40 by a drill, screwdriver, or other tool that would be appreciated by a person of skill in the art. FIG. 5 demonstrates the use of two bolts as the fasteners 44, which may, for example, be passed through holes in the upper board 42, shielding device 10, and/or joist 40. The holes through which the bolts pass may be pre-formed, drilled, or otherwise created in a way that would be appreciated by a skilled artisan.

Those skilled in the art will also appreciate that the shielding device 10 according to the present invention contemplates any number and combination of fasteners 44. These fasteners 44 may include, but may not be limited to, nails, adhesives, pins, or other devices that a skilled artisan would readily appreciate as appropriate to fasten one object to another. Such fasteners 44 may be used for securing the shielding device 10 while still accomplishing the goals, features, and objectives according to the present invention.

Many modifications and other embodiments of the invention will come to the mind of one skilled in the art having the benefit of the teachings presented in the foregoing descriptions and associated drawings. Therefore, it is understood that the invention is not to be limited to the specific embodiments disclosed, and that modifications and embodiments are intended to be included within the scope of the appended claims.

What is claimed is:

1. A shielding device comprising:

an upper member defined by a top, upper member sidewalls extending downwardly from the top, and a bottom opposite the top and connected to the upper member sidewalls, the upper member sidewalls extending substantially orthogonal between the top and the bottom;

a pair of opposing main body sidewalls that extend downwardly from the upper member, each of the pair of opposing main body sidewalls having a first portion and a second portion, wherein the first portion is connected to the upper member and extends downwardly therefrom, wherein the second portion extends downwardly and outwardly from an end of the first portion to define each of the pair of main body sidewalls as terminating with a drip edge, wherein the first portion extends inwardly so that a width between the pair of main body sidewalls adjacent the upper member is greater than a width between the pair of main body sidewalls adjacent the end of the first portion;

an upper grip longitudinally and continuously protruding along the length of the bottom of the upper member; and a side tab longitudinally and continuously protruding along the length of an inner portion of at least one of the pair of opposing main body sidewalls;

wherein the upper grip is pointed and wherein the side tab is pointed so that at least a portion of the upper grip and a portion of the side tab penetrate through a surface upon installation.

2. The shielding device according to claim 1 wherein the top of the upper member is rounded and the bottom of the upper member is flat.

3. The shielding device according to claim 1 wherein the upper grip comprises a plurality of upper grips oriented substantially parallel to one another.

4. The shielding device according to claim 1 wherein the side tab comprises a pair of opposing side tabs that extend substantially parallel to one another.

5. The shielding device according to claim 1 wherein the upper member, the pair of opposing main body sidewalls, the upper grip and the side tab are integrally formed as a monolithic unit.

6. The shielding device according to claim 1 wherein the upper member, the pair of opposing main body sidewalls, the upper grip and the side tab are made of a plastic material.

7. A shielding device comprising:

an upper member defined by a top, upper member sidewalls extending downwardly from the top, and a bottom opposite the top and connected to the upper member sidewalls, the upper member sidewalls extending substantially orthogonal between the top and the bottom;

a pair of opposing main body sidewalls that extend downwardly from the upper member, each of the pair of opposing main body sidewalls having a first portion and a second portion, wherein the first portion is connected to the upper member and extends downwardly therefrom, wherein the second portion extends downwardly and outwardly from an end of the first portion to define each of the pair of main body sidewalls as terminating with a drip edge, wherein the first portion extends inwardly so that a width between the pair of main body sidewalls adjacent the upper member is greater than a width between the pair of main body sidewalls adjacent the end of the first portion;

a plurality of upper grips continuously extending longitudinally and protruding along the length of the bottom of the upper member, the plurality of upper grips being arranged substantially parallel to one another and having a pointed shape; and a pair of opposing side tabs longitudinally and continuously protruding along the length of an inner portion of at least one of the pair of opposing main body sidewalls and wherein each of the pair of opposing side tabs have a pointed shape;

wherein the upper member, the pair of opposing main body sidewalls, the plurality of upper grips, and the pair of opposing side tabs are integrally formed as a monolithic unit;

wherein the plurality of upper grips and the pair of opposing side tabs are pointed so that so that at least a portion of each of the plurality of upper grips and a portion of each of the side tabs penetrate through a surface upon installation.

8. The shielding device according to claim 7 wherein the top of the upper member is rounded and the bottom of the upper member is flat.

9. The shielding device according to claim 7 wherein the upper member, the pair of opposing main body sidewalls, the upper grip and the side tab are made of a plastic material.

10. A method of using a shielding device that includes an upper member defined by a top, upper member sidewalls extending downwardly from the top, and a bottom opposite the top and connected to the upper member sidewalls, the upper member sidewalls extending substantially orthogonal between the top and the bottom, a pair of opposing main body sidewalls that extend downwardly from the upper member, each of the pair of opposing main body sidewalls having a first portion and a second portion, wherein the first portion is connected to the upper member and extends downwardly therefrom, wherein the second portion extends downwardly and outwardly from an end of the first portion to define each of the pair of main body sidewalls as terminating with a drip edge, wherein the first portion extends inwardly so that a width between the pair of main body sidewalls adjacent the upper member is greater than a width between the pair of main body sidewalls adjacent the end of the first portion, a plurality of upper grips continuously extending longitudinally and protruding along the length of the bottom of the upper member, the plurality of upper grips being arranged substantially parallel to one another and having a pointed shape, and a pair of opposing side tabs longitudinally and continuously protruding along the length of an inner portion of at least one of the pair of opposing main body sidewalls and wherein each of the pair of opposing side tabs have a pointed shape, the method comprising;

operatively positioning the shielding device to overlie an upper side of a joist;

applying force to the upper member of the shielding device such that the upper grip abuts the joist and a least a portion thereof penetrates through the joist; and applying force to at least one of the pair of opposing main body sidewalls such that the side tab engages at least a portion of the joist and at least a portion thereof penetrates through the joist.

11. The method according to claim 10 wherein the upper member, the pair of opposing main body sidewalls, the plurality of upper grips, and the pair of opposing side tabs are integrally formed as a monolithic unit.

12. The method according to claim 10 wherein the top of the upper member is rounded, and the bottom of the upper member is flat.

13. The method according to claim 10 wherein the pair of opposing side tabs partially bite into the joist when force is applied thereto.

14. The method according claim 10 wherein operatively positioning the shielding device to overlie the upper side of the joist further comprises attaching the shielding device to the joist using at least one selected from the group consisting of a nail, a screw, a bolt, and an adhesive.

15. The method according to claim 10 further comprising the step of securing an additional layer of building material on top of the upper member of the shielding device.

* * * * *